US011809117B2

(12) United States Patent
Nagasaki

(10) Patent No.: US 11,809,117 B2
(45) Date of Patent: Nov. 7, 2023

(54) IMAGE FORMING APPARATUS HAVING CONTROLLER FOR CONTROLLING FIRST AND SECOND CONVEYANCE ROTATOR WITH FIRST AND SECOND SUCTION FANS

(71) Applicant: CANON KABUSHIKI KAISHA, Tokyo (JP)

(72) Inventor: Tsuyoshi Nagasaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/702,872

(22) Filed: Mar. 24, 2022

(65) Prior Publication Data

US 2022/0317623 A1 Oct. 6, 2022

(30) Foreign Application Priority Data

Apr. 2, 2021 (JP) ..... 2021-063283

(51) Int. Cl.

| | |
|---|---|
| ***G03G 15/00*** | (2006.01) |
| ***G03G 21/20*** | (2006.01) |
| ***B65H 29/24*** | (2006.01) |
| *G03G 15/20* | (2006.01) |

(52) U.S. Cl.

CPC ..... *G03G 15/657* (2013.01); *B65H 29/242* (2013.01); *G03G 15/6529* (2013.01); *G03G 21/206* (2013.01); *B65H 2404/2691* (2013.01); *B65H 2406/3622* (2013.01); *G03G 15/2017* (2013.01); *G03G 15/5008* (2013.01); *G03G 2215/00413* (2013.01)

(58) Field of Classification Search

CPC ..... G03G 21/206; G03G 15/2028; G03G 15/657; G03G 15/6529; G03G 2215/00413; B65H 29/242; B65H 2301/44336; B65H 2301/44735; B65H 2404/2691; B65H 2406/32; B65H 2406/3222; B65H 2406/3622; B65H 2406/3632

USPC ..... 399/400

See application file for complete search history.

(56) References Cited

U.S. PATENT DOCUMENTS

| | | | | |
|---|---|---|---|---|
| 11,397,392 | B2 * | 7/2022 | Iwasaki | G03G 15/6529 |
| 2012/0087687 | A1 * | 4/2012 | Moteki | G03G 15/657 399/68 |
| 2021/0364965 | A1 * | 11/2021 | Matsui | G03G 15/657 |

FOREIGN PATENT DOCUMENTS

| | | |
|---|---|---|
| JP | 2012083416 A | 4/2012 |

* cited by examiner

*Primary Examiner* — Robert B Beatty
(74) *Attorney, Agent, or Firm* — ROSSI, KIMMS & McDOWELL LLP

(57) ABSTRACT

An image forming apparatus includes a transfer unit, a fixing unit, a first conveyance unit which includes a first conveyance rotator, a first suction fan, and a first suction port, a second conveyance unit which includes a second conveyance rotator, a second suction fan, and a second suction port, and a control unit. The control unit is configured to execute a first mode of changing a rotational speed of the second suction fan from a first rotational speed to a second rotational speed lower than the first rotational speed after a leading edge of the sheet passes through the fixing unit in a case where a sheet having a length longer than a length from the fixing unit to a downstream end of the first suction port in the sheet conveyance direction is conveyed.

10 Claims, 9 Drawing Sheets

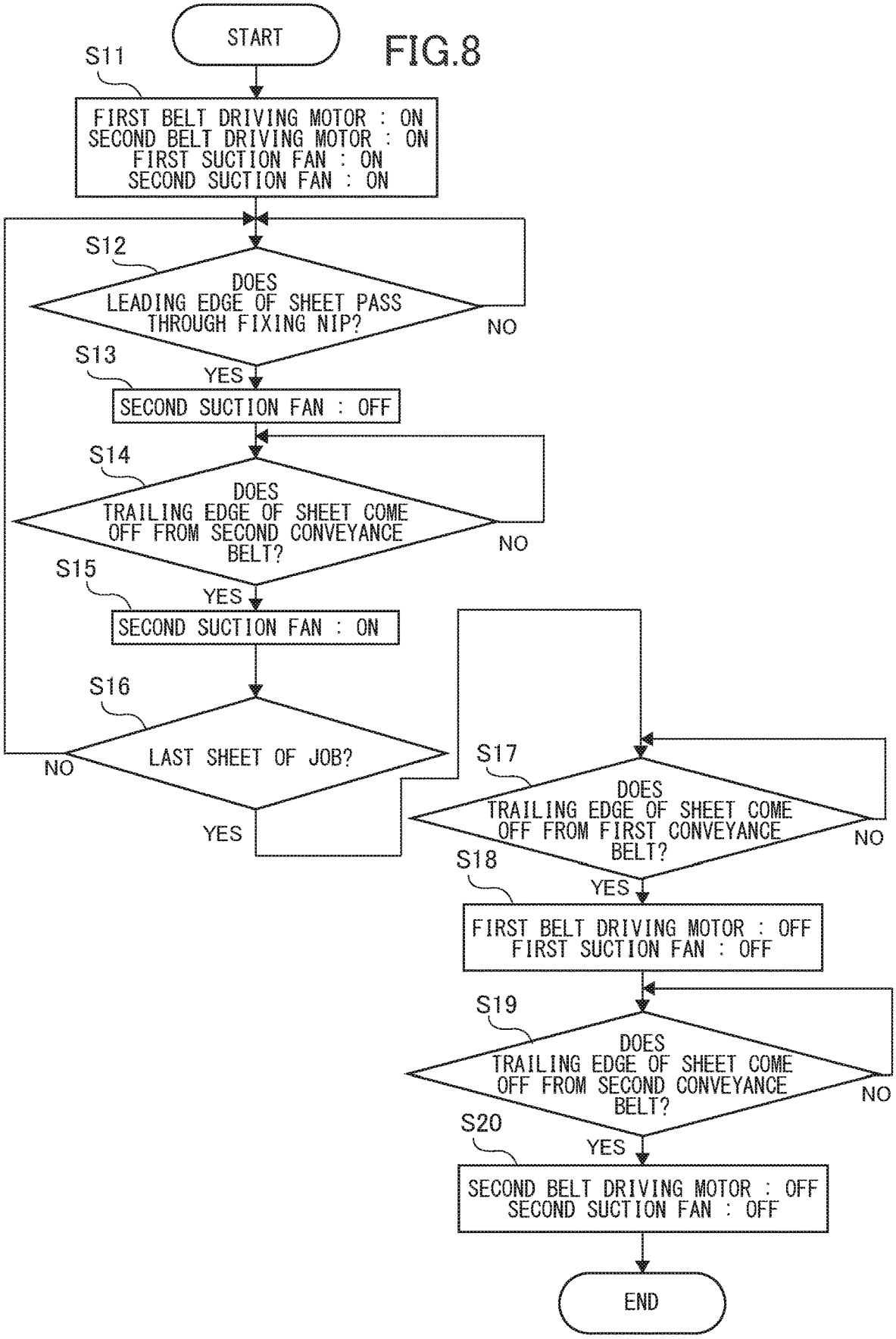
FIG.8
START
S11
FIRST BELT DRIVING MOTOR : ON
SECOND BELT DRIVING MOTOR : ON
FIRST SUCTION FAN : ON
SECOND SUCTION FAN : ON
S12
DOES LEADING EDGE OF SHEET PASS THROUGH FIXING NIP?
NO
YES
S13
SECOND SUCTION FAN : OFF
S14
DOES TRAILING EDGE OF SHEET COME OFF FROM SECOND CONVEYANCE BELT?
NO
YES
S15
SECOND SUCTION FAN : ON
S16
LAST SHEET OF JOB?
NO
YES
S17
DOES TRAILING EDGE OF SHEET COME OFF FROM FIRST CONVEYANCE BELT?
NO
YES
S18
FIRST BELT DRIVING MOTOR : OFF
FIRST SUCTION FAN : OFF
S19
DOES TRAILING EDGE OF SHEET COME OFF FROM SECOND CONVEYANCE BELT?
NO
YES
S20
SECOND BELT DRIVING MOTOR : OFF
SECOND SUCTION FAN : OFF
END

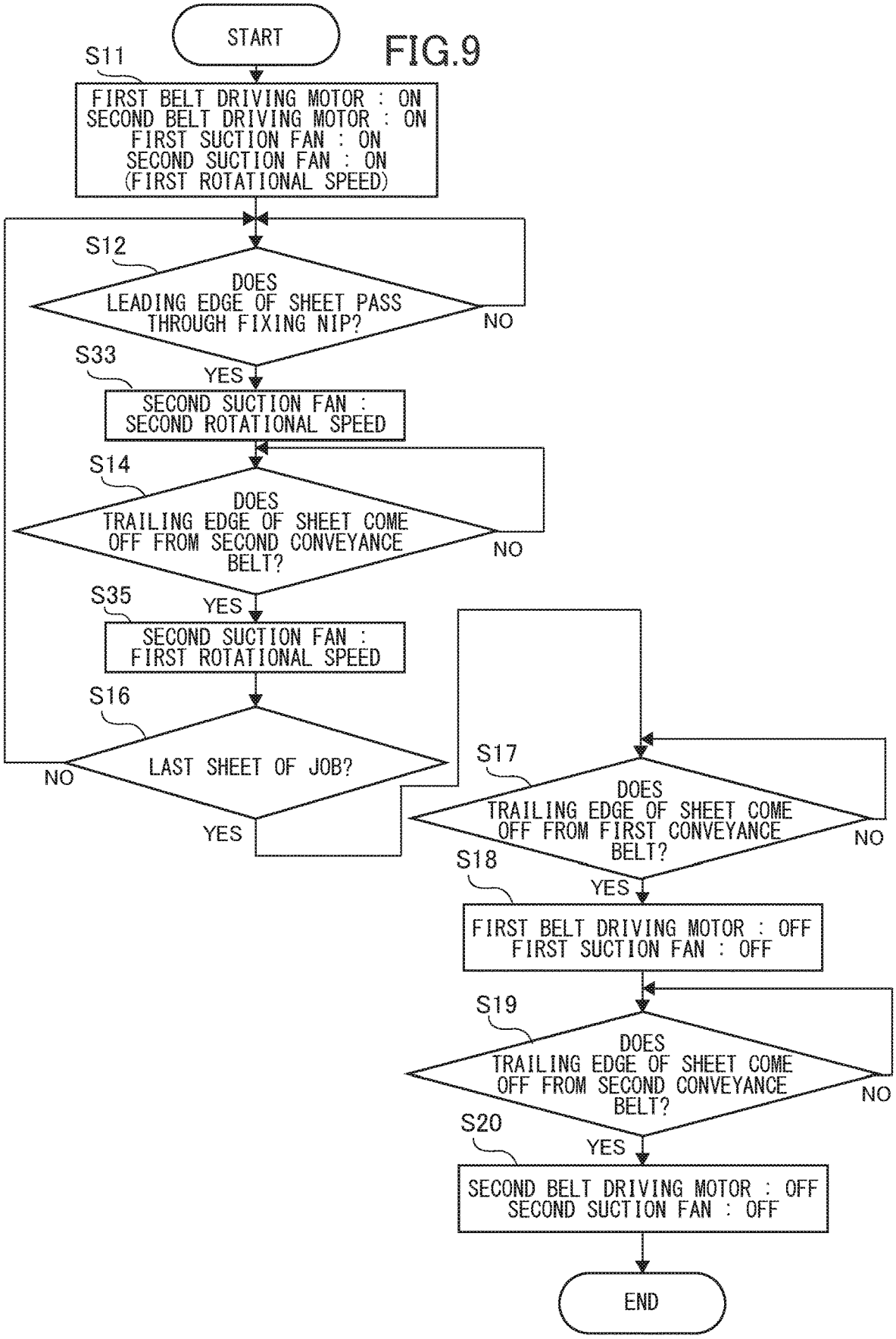
FIG.9
START
S11
FIRST BELT DRIVING MOTOR : ON
SECOND BELT DRIVING MOTOR : ON
FIRST SUCTION FAN : ON
SECOND SUCTION FAN : ON
(FIRST ROTATIONAL SPEED)
S12
DOES LEADING EDGE OF SHEET PASS THROUGH FIXING NIP?
NO
YES
S33
SECOND SUCTION FAN : SECOND ROTATIONAL SPEED
S14
DOES TRAILING EDGE OF SHEET COME OFF FROM SECOND CONVEYANCE BELT?
NO
YES
S35
SECOND SUCTION FAN : FIRST ROTATIONAL SPEED
S16
LAST SHEET OF JOB?
NO
YES
S17
DOES TRAILING EDGE OF SHEET COME OFF FROM FIRST CONVEYANCE BELT?
NO
YES
S18
FIRST BELT DRIVING MOTOR : OFF
FIRST SUCTION FAN : OFF
S19
DOES TRAILING EDGE OF SHEET COME OFF FROM SECOND CONVEYANCE BELT?
NO
YES
S20
SECOND BELT DRIVING MOTOR : OFF
SECOND SUCTION FAN : OFF
END

IMAGE FORMING APPARATUS HAVING CONTROLLER FOR CONTROLLING FIRST AND SECOND CONVEYANCE ROTATOR WITH FIRST AND SECOND SUCTION FANS

BACKGROUND OF THE INVENTION

Field of the Invention

The present invention relates to an image forming apparatus that forms an image on a sheet.

Description of the Related Art

Japanese Patent Laid-Open No. 2012-83416 proposes an image forming apparatus in which a first belt conveyance unit and a second belt conveyance unit for conveying a sheet are provided between a transfer unit and a fixing unit. Each of the first belt conveyance unit and the second belt conveyance unit includes a conveyance belt having a plurality of holes and a suction fan, and conveys the sheet while adsorbing the sheet to the conveyance belt.

However, in the image forming apparatus described in Japanese Patent Laid-Open No. 2012-83416, when a thin sheet having low rigidity is conveyed, the sheet is likely to adhere to the respective conveyance belts of the first belt conveyance unit and the second belt conveyance unit. Then, the sheet is deflected downward by the suction fan together with the conveyance belt, and the sheet in the deflected posture enters the fixing unit, so wrinkles are likely to occur in the sheet.

SUMMARY OF THE INVENTION

According to one aspect of the present invention, an image forming apparatus includes a transfer unit configured to transfer a toner image to a sheet, a fixing unit configured to fix the toner image transferred by the transfer unit to the sheet, a first conveyance unit disposed between the transfer unit and the fixing unit in a sheet conveyance direction and configured to convey the sheet while adsorbing the sheet, the first conveyance unit including, a first conveyance rotator configured to convey the sheet while sucking the sheet with a plurality of holes, a first suction fan configured to suck air, and a first suction port through which the air sucked by the first suction fan passes, and disposed on an inner peripheral side of the first conveyance rotator, a second conveyance unit disposed downstream of the first conveyance unit and upstream of the fixing unit in the sheet conveyance direction and configured to convey the sheet while adsorbing the sheet, the second conveyance unit including a second conveyance rotator configured to convey the sheet while sucking the sheet with a plurality of holes, a second suction fan configured to suck air, and a second suction port through which the air sucked by the second suction fan passes, and disposed on an inner peripheral side of the second conveyance rotator and a control unit configured to control the first suction fan and the second suction fan. The control unit is configured to execute a first mode of changing a rotational speed of the second suction fan from a first rotational speed to a second rotational speed lower than the first rotational speed after a leading edge of the sheet passes through the fixing unit in a case where a sheet having a length longer than a length from the fixing unit to a downstream end of the first suction port in the sheet conveyance direction is conveyed.

Further features of the present invention will become apparent from the following description of exemplary embodiments with reference to the attached drawings.

BRIEF DESCRIPTION OF THE DRAWINGS

FIG. 8 is a flowchart illustrating a first mode.

FIG. 9 is a flowchart illustrating a first mode according to a second embodiment

DESCRIPTION OF THE EMBODIMENTS

First Embodiment

Overall Configuration

Figure 1:
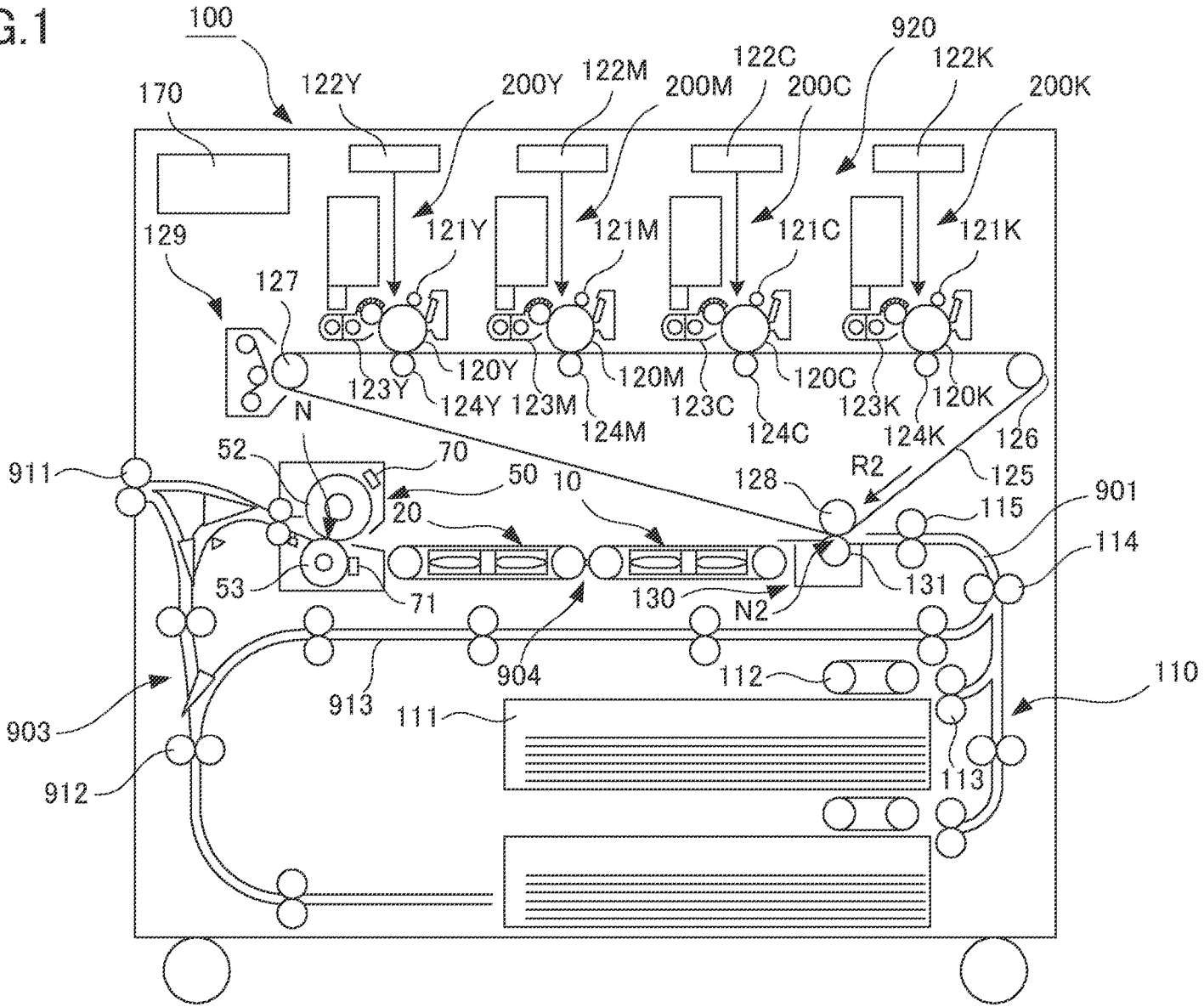
FIG. 1 is an overall schematic view illustrating a printer according to a first embodiment.

First, a first embodiment of the present invention will be described. A printer 100 (image forming apparatus) according to the first embodiment is an electrophotographic laser beam printer. As illustrated in FIG. 1, the printer 100 includes a feeding unit 110, an image forming unit 920 for forming a toner image on a sheet fed by the feeding unit 110, and a belt conveyance unit 904 that conveys the sheet on which the toner image is formed to a fixing device 50. The printer 100 further includes a rear conveyance unit 903 that conveys the sheet on which the toner image has been fixed by the fixing device 50.

The feeding unit 110 includes a sheet cassette 111 that stores sheets, a pickup roller 112 that feeds the sheets stored in the sheet cassette 111, and a separation device 113 that separates and conveys the sheets fed by the pickup roller 112 one by one. Further, the feeding unit 110 includes a delivery roller pair 114 and a registration roller pair 115 that convey a sheet in a feeding path 901 on which the sheet conveyed by the separation device 113 is conveyed. In the present embodiment, two sheet cassettes 111 are provided, and the pickup roller 112 and the separation device 113 are provided for each sheet cassette 111.

The image forming unit 920 is a tandem type image forming unit in which image forming stations 200Y, 200M, 200C, and 200K corresponding to respective colors of yellow (Y), magenta (M), cyan (C), and black (K) are arranged in series. Each of the image forming stations 200Y, 200M, 200C, and 200K includes a photosensitive drum 120, a primary charging device 121, an exposure device 122, and a developing device 123. Note that subscripts Y, M, C, and K are attached to the photosensitive drum 120, the primary charging device 121, the exposure device 122, the developing device 123, and a primary transfer roller to be described later corresponding to each image forming station. In a case where there is no particular distinction between the respective image forming stations, the image forming stations will be collectively described without subscripts of Y, M, C, and K.

The image forming unit 920 further includes an intermediate transfer belt 125 to which toner images visualized by the image forming stations 200Y, 200M, 200C, and 200K are transferred. The intermediate transfer belt 125 is stretched and supported by a driving roller 126, a tension roller 127, and a counter roller 128, and is driven by the driving roller 126 to rotate in a direction of arrow R2.

A secondary transfer roller 131 is disposed on an opposite side of the counter roller 128 with the intermediate transfer belt 125 interposed between the secondary transfer roller 131 and the counter roller 128, and the secondary transfer roller 131 forms a secondary transfer nip N2 as a transfer unit between the secondary transfer roller 131 and the intermediate transfer belt 125. The secondary transfer roller 131, the intermediate transfer belt 125, and the counter roller 128 constitute a secondary transfer unit 130. A belt cleaning device 129 slides a cleaning web on the intermediate transfer belt 125 to remove transfer residual toner, paper dust, and the like remaining on a surface of the intermediate transfer belt 125 that has passed through the secondary transfer nip N2.

The fixing device 50 disposed downstream of the secondary transfer unit 130 in the sheet conveyance direction fixes the toner image on the sheet by heat and pressure. The fixing device 50 includes a heating roller 52 including a heater 51 (see FIG. 2) therein, and a pressure roller 53 that forms a fixing nip N as a fixing unit together with the heating roller 52. Further, the fixing device 50 includes a heating roller temperature sensor 70 for detecting the surface temperature of the heating roller 52 and a pressure roller temperature sensor 71 for detecting a surface temperature of the pressure roller 53. The heating roller temperature sensor 70 and the pressure roller temperature sensor 71 are provided to maintain the surface temperatures of the heating roller 52 and the heating roller 52 at appropriate temperatures, respectively.

The belt conveyance unit 904 is disposed between the secondary transfer nip N2 and the fixing device 50 in the sheet conveyance direction. The belt conveyance unit 904 is configured to include a first belt conveyance unit 10 and a second belt conveyance unit 20 disposed downstream of the secondary transfer nip N2 and upstream of the fixing nip N in the sheet conveyance direction. The configuration of the belt conveyance unit 904 will be described in detail later.

The rear conveyance unit 903 includes a discharge roller pair 911 that discharges the sheet discharged from the fixing device 50 to the outside of the apparatus. Further, the rear conveyance unit 903 includes a reverse roller 912 that reversely conveys the sheet and a double-sided conveyance path 913 that guides the sheet reversed by the reverse roller 912 to the feeding path 901.

Next, an outline of an operation related to image formation in the printer 100 will be described. First, the exposure device 122 exposes the photosensitive drum 120 to form an electrostatic latent image on the photosensitive drum 120. The electrostatic latent image on the photosensitive drum 120 is developed by the developing device 123 and visualized as a toner image.

The toner image supported on the surface of the photosensitive drum 120 is sequentially superposed on the intermediate transfer belt 125 by the primary transfer roller 124 to be used as the primary transfer. The toner image on the intermediate transfer belt 125 on which all colors of Y, M, C, and K are primarily transferred is secondarily transferred onto the sheet fed by the feeding unit 110 at the secondary transfer nip N2.

Note that the intermediate transfer belt 125 is rotationally driven by a driving roller 126 that rotates at a constant speed, and is rotated while its peripheral speed is maintained at a constant transfer speed VT. Therefore, the sheet on which the toner image is transferred is conveyed at the transfer speed VT by the secondary transfer nip N2.

The registration roller pair 115 of the feeding unit 110 receives a sheet in a stopped state and puts the sheet on standby, and sends the sheet to the secondary transfer nip N2 in time with the toner image of the intermediate transfer belt 125. The sheet carrying the toner image transferred by the secondary transfer nip N2 is conveyed to the fixing device 50 by the belt conveyance unit 904. The fixing device 50 nips the sheet at the fixing nip N and applies heat and pressure to the unfixed toner image and fixes the unfixed toner image to the sheet. A sheet S sent from the fixing device 50 after the fixing processing is discharged to the outside of the apparatus by the discharge roller pair 911.

In the case of forming images on both sides of the sheet, the sheet sent from the fixing device 50 is conveyed to a reverse roller 912, and the reverse roller 912 switches back the sheet. The switched-back sheet is guided to the feeding path 901 via the double-sided conveyance path 913, and the toner image is formed on a second surface of the sheet similarly to a first surface. The sheet in which the images are formed on both surfaces of the sheet is discharged to the outside of the apparatus by the discharge roller pair 911 similarly to the sheet in which the images are formed on one surface of the sheet.

Belt Conveyance Unit

Figure 2:
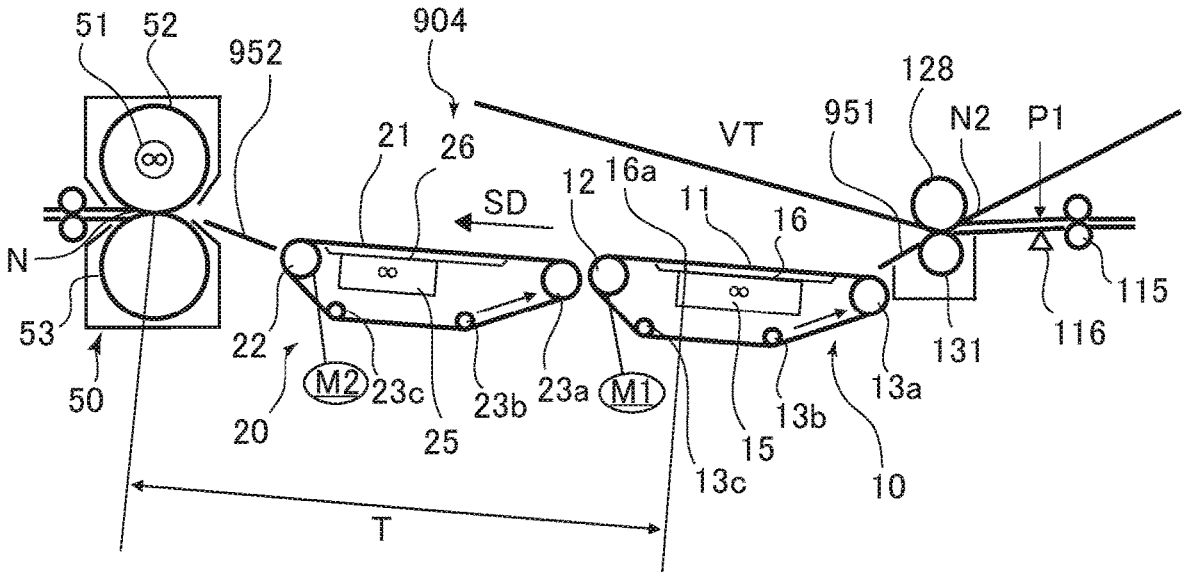
FIG. 2 is a schematic diagram illustrating a belt conveyance unit.

Next, a detailed configuration of the belt conveyance unit 904 and its periphery will be described with reference to FIGS. 2 to 4. The belt conveyance unit 904 includes a first belt conveyance unit 10 that is disposed downstream of the secondary transfer nip N2 in a sheet conveyance direction SD, and a second belt conveyance unit 20 that is disposed downstream of the first belt conveyance unit 10 and upstream of the fixing nip N.

A transfer guide 951 that guides the sheet sent from the secondary transfer nip N2 to the belt conveyance unit 904 is provided between the belt conveyance unit 904 and the secondary transfer nip N2. In addition, a pre-fixing guide 952 that guides the sheet conveyed by the belt conveyance unit 904 to the fixing nip N is provided between the belt conveyance unit 904 and the fixing nip N. In addition, a sheet detection sensor 116 as a detection unit that detects the position of the sheet is provided between the registration roller pair 115 and the secondary transfer nip N2 in the sheet conveyance direction SD.

Figure 3:
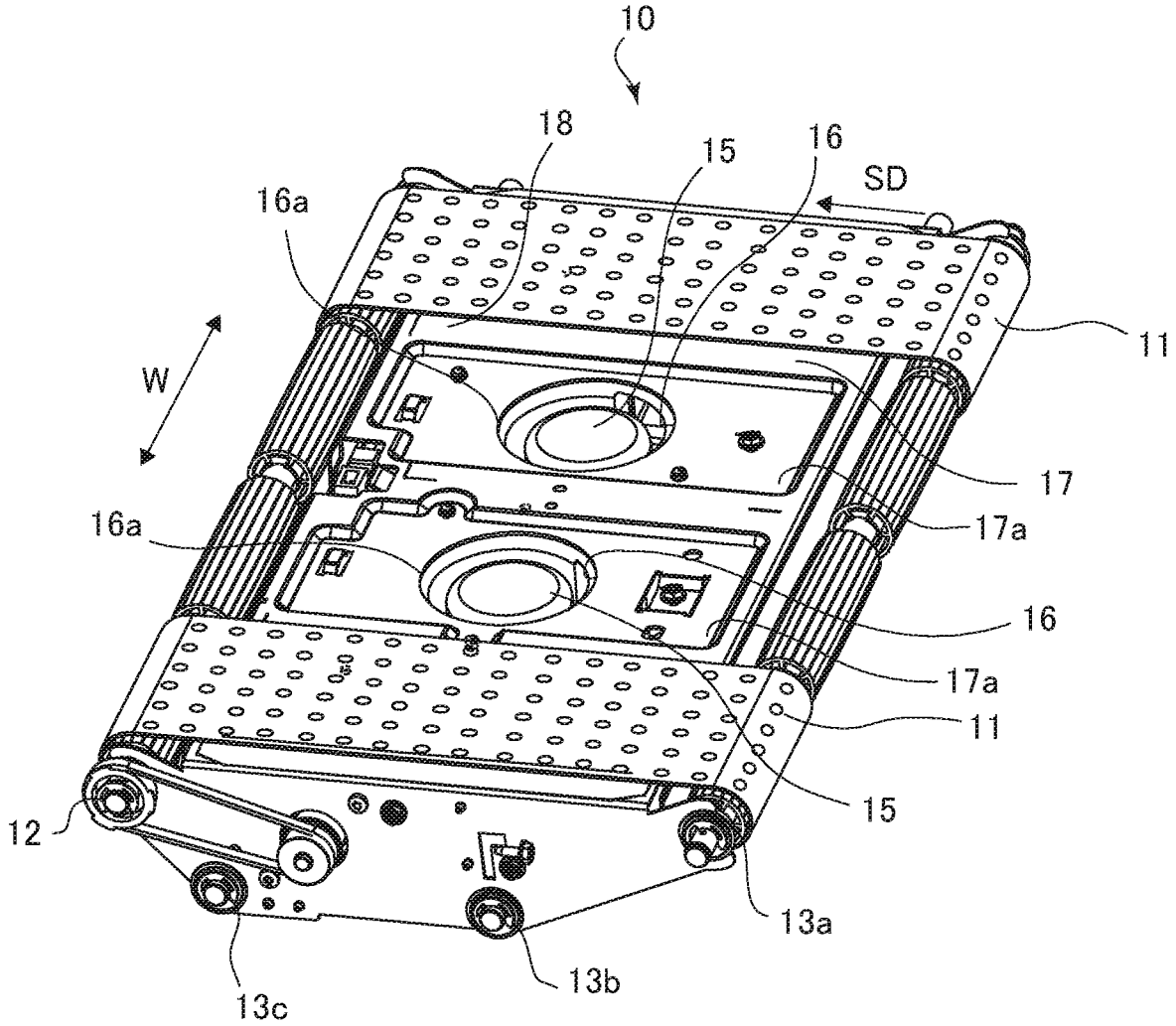
FIG. 3 is a perspective view illustrating a first belt conveyance unit.

FIG. 3 is a perspective view illustrating the first belt conveyance unit 10, and two first conveyance belts 11 on a center side are omitted to illustrate a first suction port 16. As illustrated in FIGS. 2 and 3, the first belt conveyance unit 10 as the first conveyance unit includes four endless first conveyance belts 11 provided with a plurality of holes 11*a*. The four first conveyance belts 11 as the first conveyance rotator are disposed side by side in a width direction W orthogonal to the sheet conveyance direction SD, and are wound around a first driving roller 12 and driven rollers 13*a*, 13*b*, and 13*c*. The first driving roller 12 is driven by a first belt driving motor M1, and the first conveyance belt 11 rotates as the first driving roller 12 is driven.

As illustrated in FIG. 3, a first base portion 18 is provided on an inner peripheral side of the four first conveyance belts 11, and two first suction fans 15 that suck air are provided inside the first base portion 18. A gap is provided between the first conveyance belt 11 and the first base portion 18 to suppress the sliding of the first conveyance belt 11 with respect to the first base portion 18. An upper surface 17 of the first base portion 18 is provided with two recessed portions 17*a* recessed downward, and each recessed portion 17*a* is provided with a first suction port 16. The two first suction ports 16 are disposed at the same position in the sheet conveyance direction SD.

The two first suction fans 15 are disposed on the inner peripheral side of the two first conveyance belts 11 on the center side in the width direction W among the four first conveyance belts 11, and suck air via the first suction port 16 provided in the first base portion 18. That is, the first suction fan 15 sucks air through the plurality of holes 11*a* of the first conveyance belt 11 and the first suction port 16 to adsorb the sheet placed on the upper surface of the first conveyance belt 11 to the first conveyance belt 11. In addition, since the two recessed portions 17*a* are formed on the upper surface 17 of the first base portion 18 along the two first conveyance belts 11 on the center side, a wide region of the first conveyance belt 11 can be sucked by the first suction fan 15.

The second belt conveyance unit 20 has substantially the same configuration as the first belt conveyance unit 10 described above. As illustrated in FIGS. 2 and 4, the second belt conveyance unit 20 as the second conveyance unit includes four endless second conveyance belts 21 provided with the plurality of holes 21*a*. The four second conveyance belts 21 as the second conveyance rotator are disposed side by side in the width direction W orthogonal to the sheet conveyance direction SD, and are wound around a second driving roller 22 and driven rollers 23*a*, 23*b*, and 23*c*. The second driving roller 22 is driven by a second belt driving motor M2, and the second conveyance belt 21 rotates as the second driving roller 22 is driven.

Figure 4:
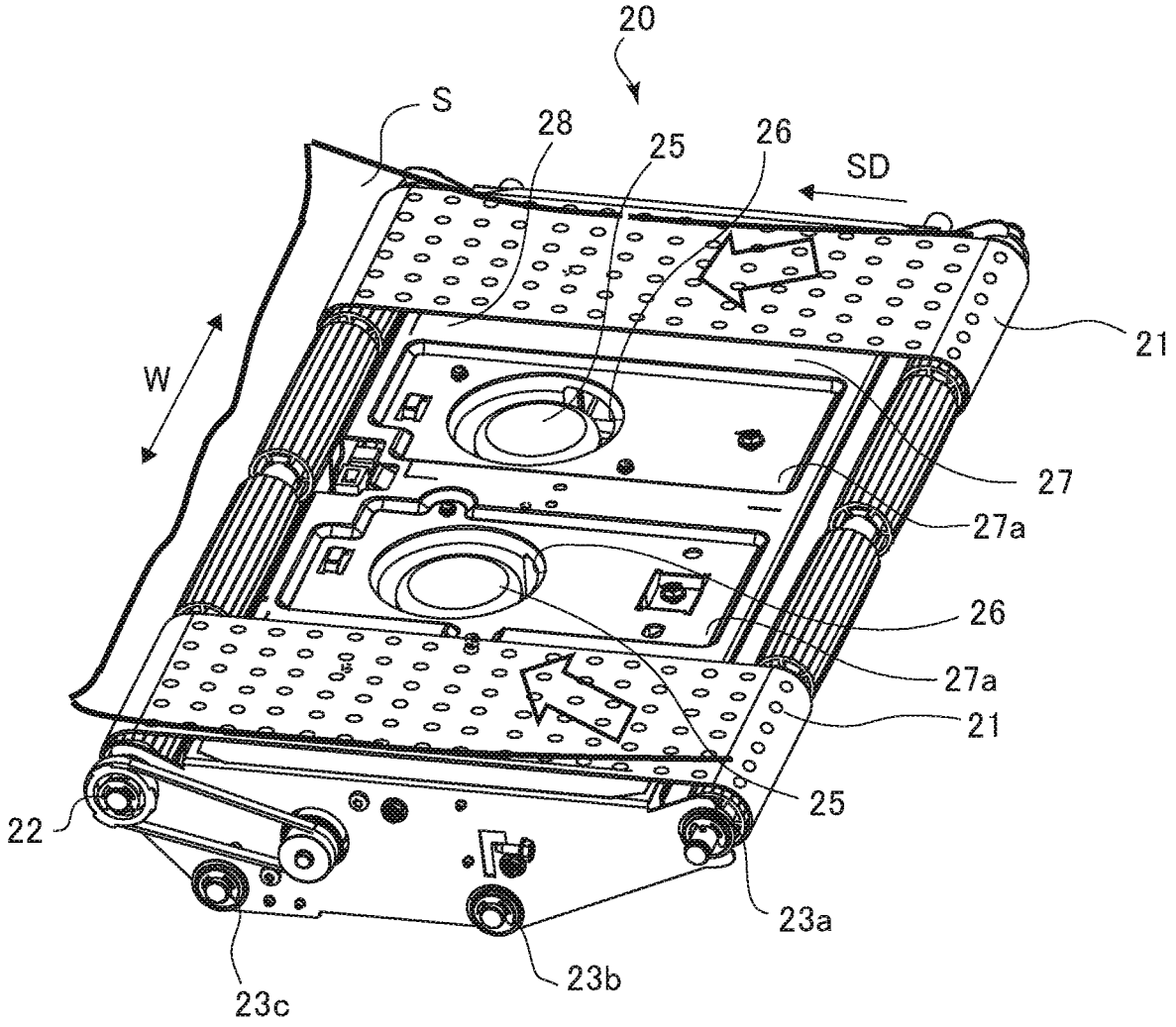
FIG. 4 is a perspective view illustrating a second belt conveyance unit.

As illustrated in FIG. 4, a second base portion 28 is provided on an inner peripheral side of the four second conveyance belts 21, and two second suction fans 25 that suck air are provided inside the second base portion 28. A gap is provided between the second conveyance belt 21 and the second base portion 28 to suppress the sliding of the second conveyance belt 21 with respect to the second base portion 28. An upper surface 27 of the second base portion 28 is provided with two recessed portions 27*a* recessed downward, and each recessed portion 27*a* is provided with a second suction port 26. The two second suction ports 26 are disposed at the same position in the sheet conveyance direction SD.

The two second suction fans 25 are disposed on the inner peripheral side of the two second conveyance belts 21 on the center side in the width direction W among the four second conveyance belts 21, and suck air via the second suction port 26 provided in the second base portion 28. That is, the second suction fan 25 sucks air through the plurality of holes 21*a* of the second conveyance belt 21 and the second suction port 26 to attract the sheet placed on the upper surface of the second conveyance belt 21 to the second conveyance belt 21. In addition, since the two recessed portions 27*a* are formed on the upper surface 27 of the second base portion 28 along the two second conveyance belts 21 on the center side, a wide region of the second conveyance belt 21 can be sucked by the second suction fan 25.

Control Block

Figure 5:
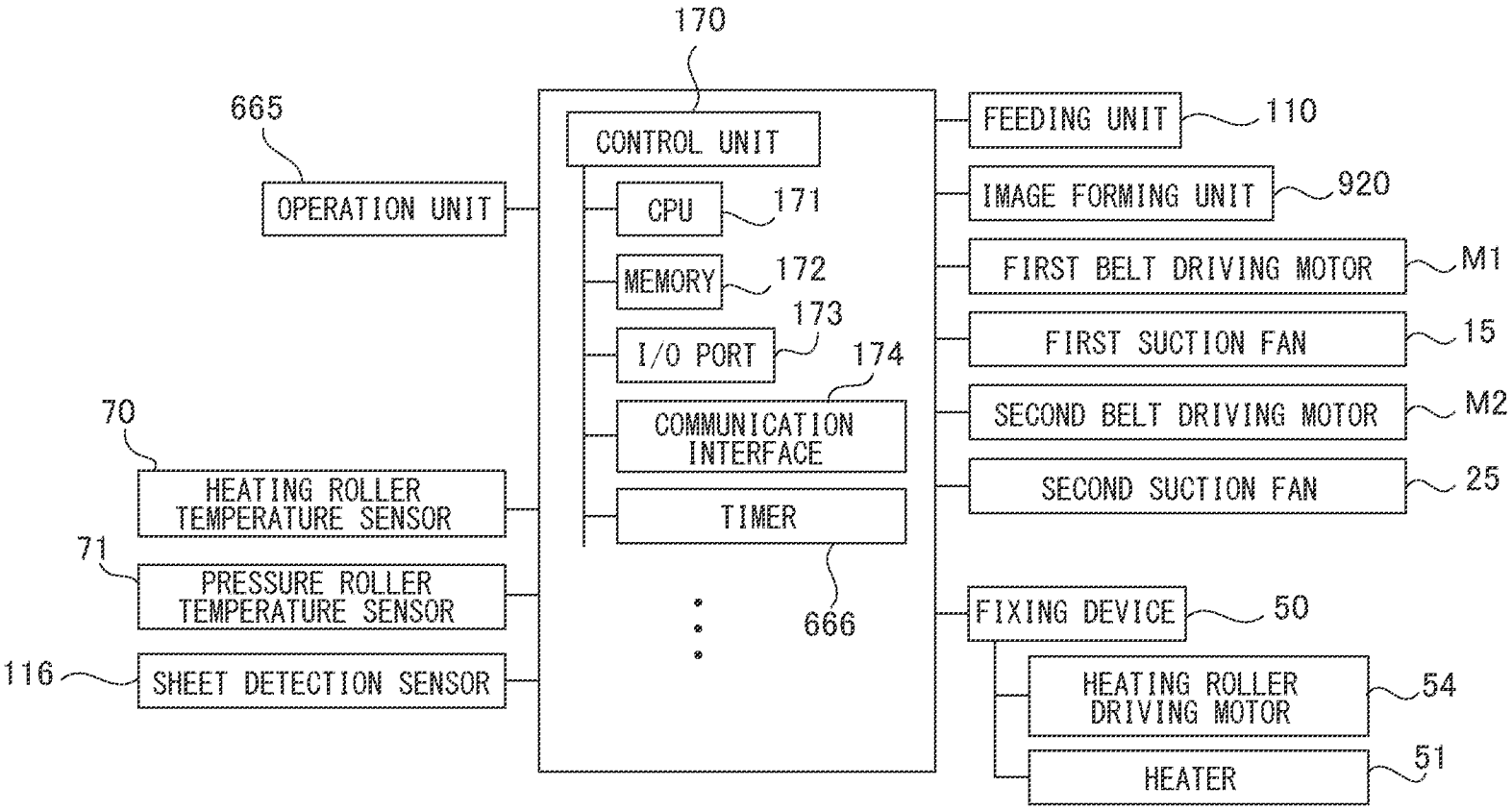
FIG. 5 is a block diagram illustrating a control block.

FIG. 5 is a block diagram illustrating a control block of the printer 100. As illustrated in FIG. 5, a control unit 170 of the printer 100 includes a CPU 171, a memory 172, an I/O port 173, a communication interface 174, a timer 666, and the like. The memory 172 is configured to include a ROM in which various programs are stored, a RAM used as a work area of the CPU 171, and the like. The I/O port 173 and the communication interface 174 constitute a circuit that exchanges data with the outside.

A heating roller temperature sensor 70, a pressure roller temperature sensor 71, a sheet detection sensor 116, and the like are connected to an input side of the control unit 170. The feeding unit 110, the image forming unit 920, the first belt driving motor M1, the first suction fan 15, the second belt driving motor M2, the second suction fan 25, and the heating roller driving motor 54 and the heater 51 of the fixing device 50 are connected to the output side of the control unit 170. The heating roller driving motor 54 drives the heating roller 52.

In addition, an operation unit 665 is connected to the control unit 170, and a user can input various settings of the printer 100 and attribute information such as a size, a grammage, and a type of sheet by operating the operation unit 665. Examples of the type of sheet include plain paper and coated paper. The coated paper is a resin-coated sheet. Note that various settings of the printer 100 and the attribute information of the sheet can also be input from an information terminal such as an external PC via the I/O port 173 or the communication interface 174.

Suction Conveyance Control

Meanwhile, when the sheet conveyed by the belt conveyance unit 904 is a thin sheet having a low grammage, the first conveyance belt 11 or the second conveyance belt 21 is likely to adhere to the sheet by a suction force of the first suction fan 15 and the second suction fan 25. For example, as illustrated in FIG. 4, in a state where the sheet S adheres to the second conveyance belt 21, the sheet S is likely to be attracted to the second suction port 26 together with the second conveyance belt 21.

Therefore, the sheet S is likely to be recessed around the second suction port 26, and the sheet S has a deflected shape as indicated by a broken line in FIG. 4. In addition, on the upstream side of the second suction port 26 in the sheet conveyance direction SD, the sheet S is conveyed while moving toward the second suction port 26 as indicated by an arrow in FIG. 4.

This deflection of the sheet S continues slowly to the fixing nip N, and the sheet S entering the fixing nip N may not enter the nip line of the fixing nip N straight. When the sheet S passes through the fixing nip N in this state, the deflection of the sheet S may be crushed to cause wrinkles. In particular, as the length of the sheet S is longer in the sheet conveyance direction SD, the amount attracted to the second suction port 26 increases, and the occurrence frequency of wrinkles increases.

Figure 6:
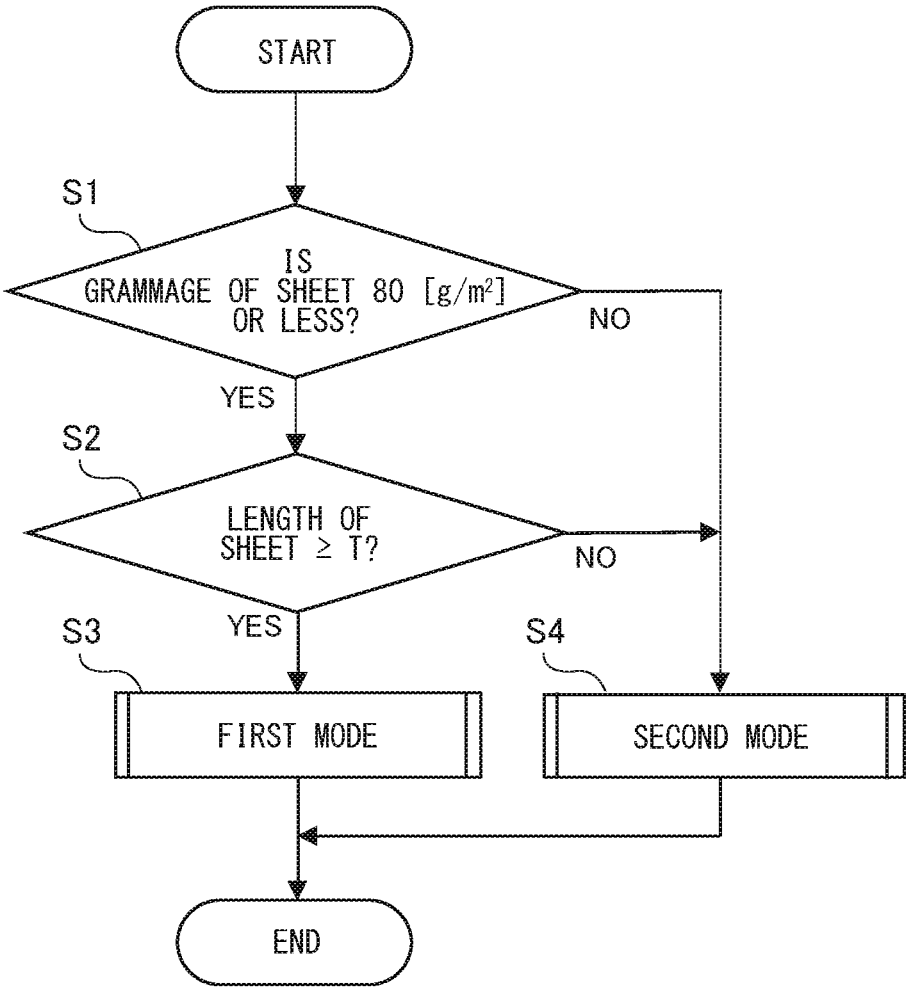
FIG. 6 is a flowchart illustrating suction conveyance control.

In order to solve such a problem, in the present embodiment, the suction conveyance control illustrated in FIG. 6 is executed. As illustrated in FIG. 6, when a print job is input, the control unit 170 determines whether the grammage of the conveyed sheet P is 80 [g/m$^2$] or less on the basis of the attribute information of the sheet P input from the operation unit 665, an external PC, or the like (step S1).

When the grammage of the sheet P is 80 [g/m$^2$] or less (step S1: YES), the control unit 170 determines whether the length of the sheet P in the sheet conveyance direction SD is equal to or longer than a length T (see FIG. 2) (step S2). The length T is a length from the fixing nip N to a downstream end 16*a* (see FIG. 3) of the first suction port 16 in the sheet conveyance direction SD.

Note that the grammage of the sheet P or the length of the sheet P in the sheet conveyance direction SD is not limited to the information input from the operation unit 665, the external PC, or the like, and may be detected by, for example, the sheet cassette 111, a media sensor provided in the conveyance path, or the like.

When the length of the sheet P in the sheet conveyance direction SD is equal to or longer than the length T (step S2: YES), the control unit 170 executes a first mode to be described later (step S3). In addition, when the grammage of the sheet is more than 80 [g/m$^2$] (step S1: NO) or when the length of the sheet P in the sheet conveyance direction SD is less than the length T (step S2: NO), the control unit 170 executes a second mode to be described later (step S4).

A sheet having a grammage of 80 [g/m$^2$] or less has a relatively low rigidity, and as described above, wrinkles are likely to be generated by the suction force of the second suction fan 25. In addition, the sheet having the length T or more is a relatively long sheet, and as described above, wrinkles are likely to be generated by the suction force of the second suction fan 25.

Further, even when a leading edge of the sheet having the length T or more reaches the fixing nip N, a trailing edge side thereof remains on the first conveyance belt 11. Therefore, the sheet S is conveyed while being sucked by the first conveyance belt 11 and the first suction fan 15, and is stably delivered from the first conveyance belt 11 to the second conveyance belt 21. In a state where the trailing edge of the sheet S is delivered from the first conveyance belt 11 to the second conveyance belt 21, the sheet S is reliably nipped by the fixing nip N, and thus can be conveyed by the fixing nip N. Under such circumstances, in the first mode, the second suction fan 25 is controlled to reduce wrinkles of the sheet S.

Second Mode

Figure 7:
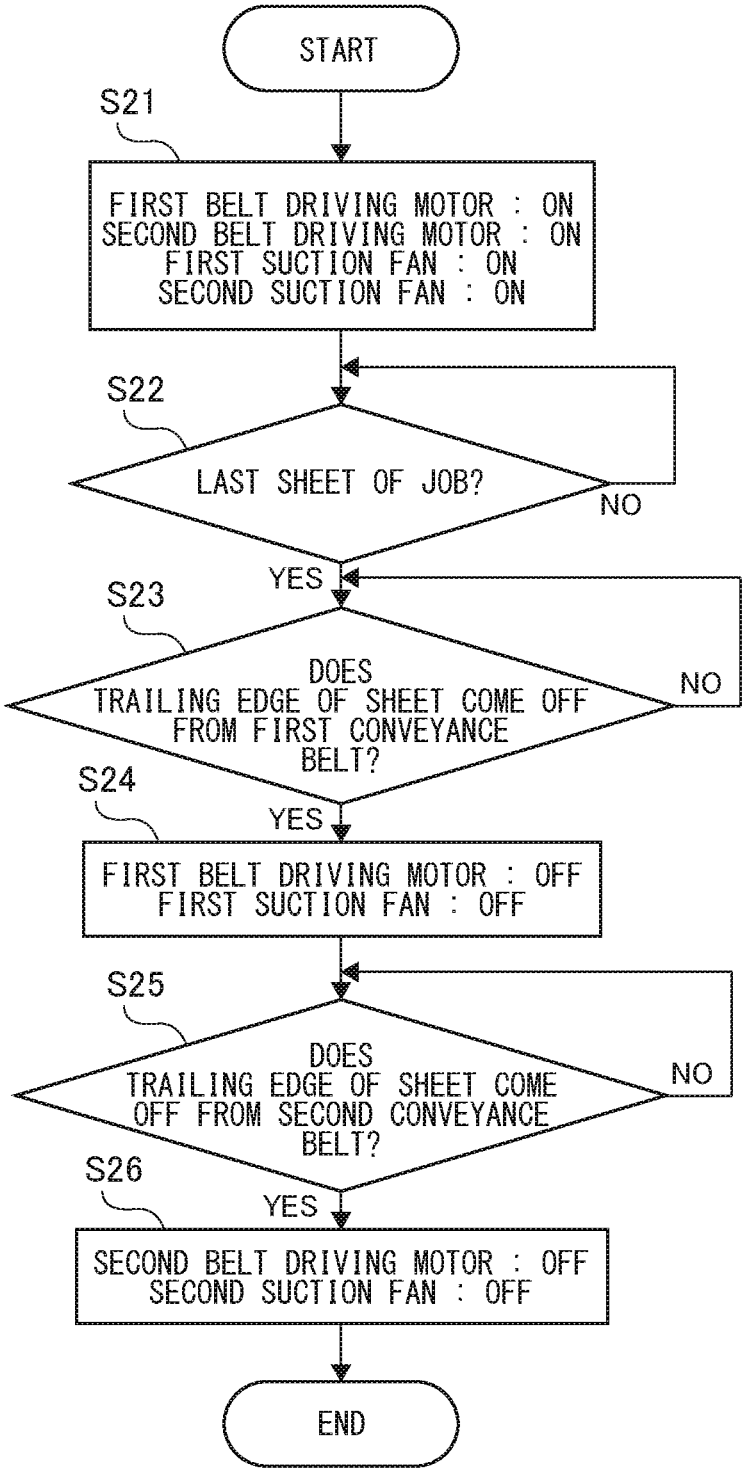
FIG. 7 is a flowchart illustrating a second mode.

First, the second mode will be described with reference to FIG. 7. As illustrated in FIG. 7, when the second mode is executed, the control unit 170 turns on the first belt driving motor M1, the second belt driving motor M2, the first suction fan 15, and the second suction fan 25 (step S21). Note that the first belt driving motor M1 and the first suction fan 15 may be turned on at any timing as long as the first belt driving motor M1 and the first suction fan 15 rotate at rated speed until the leading edge of the sheet S reaches the first conveyance belt 11. Similarly, the second belt driving motor M2 and the second suction fan 25 may be turned on at any timing as long as the second belt driving motor M2 and the second suction fan 25 rotate at rated speed until the leading edge of the sheet S reaches the second conveyance belt 21.

In the second mode, the first belt driving motor M1, the second belt driving motor M2, the first suction fan 15, and the second suction fan 25 continue to be driven even when each sheet S in the job passes through the first conveyance belt 11 and the second conveyance belt 21.

Next, the control unit 170 determines whether the conveyed sheet is the last sheet of the job (step S22). When the sheet to be conveyed is the last sheet of the job (step S22: YES), the control unit 170 determines whether or not the trailing edge of the sheet S has come off from the first conveyance belt 11 (step S23).

When it is determined that the trailing edge of the sheet S has come off from the first conveyance belt 11 (step S23: YES), the control unit 170 turns off the first belt driving motor M1 and the first suction fan 15 (step S24).

Next, the control unit 170 determines whether the trailing edge of the sheet S has passed through the second conveyance belt 21 (step S25). When it is determined that the trailing edge of the sheet S has come off from the second conveyance belt 21 (step S25: YES), the control unit 170 turns off the second belt driving motor M2 and the second suction fan 25 (step S26). Thus, the suction conveyance control in the second mode is ended.

That is, in the second mode, the first suction fan 15 continues to be driven until the trailing edge of the last sheet of the job passes through the first conveyance belt 11 after the leading edge of the first sheet of the job reaches the first conveyance belt 11. In addition, the second suction fan 25 continues to be driven until the trailing edge of the last sheet of the job passes through the second conveyance belt 21 after the leading edge of the first sheet of the job reaches the second conveyance belt 21.

First Mode

Next, the first mode will be described with reference to FIG. 8. As illustrated in FIG. 8, when the first mode is executed, the control unit 170 turns on the first belt driving motor M1, the second belt driving motor M2, the first suction fan 15, and the second suction fan 25 (step S11). Note that the first belt driving motor M1 and the first suction fan 15 may be turned on at any timing as long as the first belt driving motor M1 and the first suction fan 15 rotate at rated speed until the leading edge of the sheet S reaches the first conveyance belt 11. Similarly, the second belt driving motor M2 and the second suction fan 25 may be turned on at any timing as long as the second belt driving motor M2 and the second suction fan 25 rotate at rated speed until the leading edge of the sheet S reaches the second conveyance belt 21. At this time, the second suction fan 25 is driven at a first rotational speed. Then, the control unit 170 drives the second suction fan 25 at the first rotational speed at least until the leading edge of the sheet S reaches the second conveyance belt 21 and then reaches the fixing nip N.

Next, the control unit 170 determines whether the leading edge of the sheet S has passed through the fixing nip N (step S12). When it is determined that the leading edge of the sheet S has passed through the fixing nip N (step S12: YES), the control unit 170 turns off the second suction fan 25, that is, stops the driving (step S13). Note that the timing to turn off the second suction fan 25 may be any timing as long as the timing is after the leading edge of the sheet S passes through the fixing nip N and before the trailing edge of the sheet passes through the second conveyance belt 21.

The control unit 170 determines whether the trailing edge of the sheet S has come off from the second conveyance belt 21 (step S14). When it is determined that the trailing edge of the sheet S has come off from the second conveyance belt 21 (step S14: YES), the control unit 170 turns on, that is, drives the second suction fan 25 (step S15).

Next, the control unit 170 determines whether the conveyed sheet is the last sheet of the job (step S16). When the conveyed sheet is not the last sheet of the job (step S16: NO), the process returns to step S12. That is, in the case of a job of printing on a plurality of sheets, the processes of steps S12 to S15 are executed from the first sheet to the sheet before the last sheet of the job.

When the conveyed sheet is the last sheet of the job (step S16: YES), the process proceeds to step S17. Since steps S17 to S20 are similar to steps S23 to S26 (see FIG. 7) of the second mode described above, the description thereof will be omitted. Thus, the suction conveyance control in the first mode is ended.

As described above, in the present embodiment, the first mode is executed on the sheet having the grammage of 80 [g/m$^2$] or less and the length T or more, and the second mode is executed on other sheets. In the second mode, since the rigidity of the sheet is relatively high, the wrinkles of the sheet due to the suction force of the second suction fan 25 hardly occur. Then, since the sheet is conveyed while the driving of the first suction fan 15 and the second suction fan 25 is maintained, it is possible to preferably convey the sheet.

On the other hand, in the first mode, since the rigidity of the sheet is relatively low, the wrinkles of the sheet due to the suction force of the second suction fan 25 are likely to occur when the second suction fan 25 is continuously driven. Therefore, in the present embodiment, the second suction fan 25 is turned off to stop driving after the leading edge of the sheet passes through the fixing nip N.

As a result, as indicated by arrows in FIG. 4, even if the sheet S is closer to the width direction W toward the second suction port 26, this is eliminated. Then, since the sheet S is conveyed by the fixing nip N in a state where the deflection of the sheet S is eliminated, the occurrence of wrinkles on the sheet S can be suppressed.

Note that, in the first mode and the second mode, the position of the sheet S is obtained based on, for example, the detection result of the sheet detection sensor 116, but the present embodiment is not limited thereto. For example, the position of the sheet S may be obtained based on a detection result of another sheet detection sensor in the conveyance path in the printer 100, a feeding timing of the sheet S, or the like.

Second Embodiment

Next, a second embodiment of the present invention will be described, but the second embodiment is a modification of the contents of the first mode of the first embodiment. Therefore, a configuration similar to that of the first embodiment will be described by omitting illustration or attaching the same reference numerals to the drawings.

In the second embodiment, as illustrated in FIG. 6, the first mode and the second mode are determined, and the second mode is the same as that of the first embodiment. On the other hand, the control of the first mode is slightly different from that of the first embodiment, and differences from the first mode of the first embodiment will be mainly described.

As illustrated in FIG. 9, when the first mode is executed, the control unit 170 turns on the first belt driving motor M1, the second belt driving motor M2, the first suction fan 15, and the second suction fan 25 (step S11). At this time, the second suction fan 25 is driven at a first rotational speed.

Next, the control unit 170 determines whether the leading edge of the sheet S has passed through the fixing nip N (step S12). When it is determined that the leading edge of the sheet S has passed through the fixing nip N (step S12: YES), the control unit 170 drives the second suction fan 25 at the second rotational speed lower than the first rotational speed (step S33). Note that the timing of switching the rotational speed of the second suction fan 25 may be any timing as long as it is after the leading edge of the sheet S passes through the fixing nip N and before the trailing edge of the sheet passes through the second conveyance belt 21.

The control unit 170 determines whether the trailing edge of the sheet S has come off from the second conveyance belt 21 (step S14). When it is determined that the trailing edge of the sheet S has come off from the second conveyance belt 21 (step S14: YES), the control unit 170 changes the rotational speed of the second suction fan 25 from the second rotational speed to the first rotational speed (step S35). Since steps S16 to S20 are similar to those of the first embodiment described above, the description thereof will be omitted.

As described above, in the present embodiment, in the first mode, the rotational speed of the second suction fan 25 changes from the first rotational speed to the second rotational speed lower than the first rotational speed after the leading edge of the sheet passes through the fixing nip N. As a result, as indicated by arrows in FIG. 4, even if the sheet S is closer to the width direction W toward the second suction port 26, this is eliminated. Then, since the sheet S is conveyed by the fixing nip N in a state where the deflection of the sheet S is eliminated, the occurrence of wrinkles on the sheet S can be suppressed.

Note that the first rotational speed and the second rotational speed may be arbitrarily set. In addition, even in the first embodiment, it can be said that the rotational speed of the first suction fan 15 changes from the first rotational speed (positive number larger than 0) to the second rotational speed (speed 0) lower than the first rotational speed by turning the first suction fan 15 from on to off.

Other Embodiments

Note that, in any of the embodiments described above, it is determined in step S1 whether the grammage of the sheet is 80 [g/m$^2$] or less, but the embodiment is not limited thereto. That is, in step S1, it may be determined whether or not the grammage of the sheet is equal to or less than a predetermined grammage, and the grammage of the sheet at this time is a value that is easily deflected due to the suction force of the first suction fan 15.

In addition, in any of the embodiments described above, the first suction fan 15 continues to be driven until the trailing edge of the last sheet of the job passes through the first conveyance belt 11 after the leading edge of the first sheet of the job reaches the first conveyance belt 11 in the first mode, but the present embodiment is not limited thereto. For example, the first suction fan 15 may also be controlled in the same manner as the second suction fan. That is, the rotational speed of the first suction fan 15 may change from a third rotational speed to a fourth rotational speed (including 0) lower than the third rotational speed after the leading edge of the sheet passes through the fixing nip N. The third rotational speed and the fourth rotational speed may be arbitrarily set.

However, the first suction fan 15 is located farther from the fixing nip N in the sheet conveyance direction SD than the second suction fan, and the effect of suppressing the wrinkles of the sheet is limited. Therefore, in the above-described embodiment, the stable conveyance of the sheet S is prioritized, and the control of changing the first suction fan 15 from the third rotational speed to the fourth rotational speed is not performed.

In addition, in any of the embodiments described above, the first mode is executed on the sheet having the grammage of 80 [g/m$^2$] or less and the length T or more, but the present embodiment is not limited thereto. For example, even if the grammage is not 80 [g/m$^2$] or less, the first mode may be executed on the sheet having the length T or more, and the second mode may be executed on other sheets. Further, the mode is not limited to the two modes of the first mode and the second mode, and three or more modes may be selectively used.

In addition, in any of the embodiments described above, the fixing device 50 is configured to include the heating roller 52 and the pressure roller 53, but the present embodiment is not limited thereto. For example, instead of the heating roller 52, a flexible film, a heater for heating the film, and a frame for guiding the film may be applied. Further, the heater may not be in direct contact with the film, and may be in contact with the film via a sheet material having high thermal conductivity such as an iron alloy or aluminum.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No 2021-063283, filed Apr. 2, 2021, which is hereby incorporated by reference herein in its entirety.

What is claimed is:

1. An image forming apparatus comprising:

a transfer unit configured to transfer a toner image to a sheet;

a fixing unit configured to fix the toner image transferred by the transfer unit to the sheet;

a first conveyance unit disposed between the transfer unit and the fixing unit in a sheet conveyance direction and configured to convey the sheet while holding the sheet, the first conveyance unit including:

a first conveyance rotator configured to convey the sheet while sucking the sheet with a plurality of holes;

a first suction fan configured to suck air; and a first suction port through which the air sucked by the first suction fan passes, and disposed on an inner peripheral side of the first conveyance rotator;

a second conveyance unit disposed downstream of the first conveyance unit and upstream of the fixing unit in the sheet conveyance direction and configured to convey the sheet while holding the sheet, the second conveyance unit including:

a second conveyance rotator configured to convey the sheet while sucking the sheet with a plurality of holes;

a second suction fan configured to suck air; and a second suction port through which the air sucked by the second suction fan passes, and disposed on an inner peripheral side of the second conveyance rotator; and a control unit configured to control the first suction fan and the second suction fan, wherein the control unit is configured to execute a first mode of changing a rotational speed of the second suction fan from a first rotational speed to a second rotational speed lower than the first rotational speed in a state where a leading edge of the sheet is positioned downstream of the fixing unit in the sheet conveyance direction and where a trailing edge of the sheet is held by the first conveyance unit.

2. The image forming apparatus according to claim 1, wherein the control unit stops driving of the second suction fan after the leading edge of the sheet passes through the fixing unit in the first mode.

3. The image forming apparatus according to claim 1, wherein the control unit changes the rotational speed of the second suction fan from the second rotational speed to the first rotational speed after the trailing edge of the sheet passes through the second conveyance unit in the first mode.

4. The image forming apparatus according to claim 1, wherein, in the first mode, the control unit drives the first suction fan, after a leading edge of a first sheet of a job reaches the first conveyance rotator, until a trailing edge of a last sheet of the job passes through the first conveyance rotator.

5. The image forming apparatus according to claim 1, wherein, in the first mode, the control unit drives the second suction fan at the first rotational speed until the leading edge of the sheet reaches the fixing unit after the leading edge of the sheet reaches the second conveyance rotator.

6. The image forming apparatus according to claim 1, wherein the control unit executes the first mode on a sheet having a length longer than a length from the fixing unit to a downstream end of the first suction port in the sheet conveyance direction and having a predetermined grammage or less.

7. The image forming apparatus according to claim 1, further comprising a detection unit configured to detect a position of the sheet.

8. The image forming apparatus according to claim 1, wherein the control unit executes a second mode of continuing to drive the first suction fan until a trailing edge of a last sheet of a job passes through the first conveyance rotator after a leading edge of a first sheet of the job reaches the first conveyance rotator, and continuing to drive the second suction fan until the trailing edge of the last sheet of the job passes through the second conveyance rotator after the leading edge of the first sheet of the job reaches the second conveyance rotator.

9. The image forming apparatus according to claim 8, wherein the control unit executes the second mode on a sheet having a length less than a length from the fixing unit to a downstream end of the first suction port in the sheet conveyance direction or having a predetermined grammage or more.

10. The image forming apparatus according to claim 1, wherein each of the first conveyance rotator and the second conveyance rotator is a belt.

* * * * *